US006157096A

United States Patent [19]

Vinciguerra

[11] Patent Number: 6,157,096

[45] Date of Patent: Dec. 5, 2000

[54] NEUTRAL SWITCHED SHUNT TRIP EMERGENCY GAS PANEL

[76] Inventor: John Vinciguerra, 2738 20th Ave. N., St. Petersburg, Fla. 33713

[21] Appl. No.: 09/315,151

[22] Filed: May 20, 1999

[51] Int. Cl.[7] ..... H01H 47/00

[52] U.S. Cl. ..... 307/125

[58] Field of Search ..... 361/23, 115; 307/38, 307/39, 125

[56] References Cited

U.S. PATENT DOCUMENTS

| | | | |
|---|---|---|---|
| 3,742,305 | 6/1973 | Hobson, Jr. et al. | 317/18 |
| 4,104,724 | 8/1978 | Dix et al. | 364/477 |
| 4,181,922 | 1/1980 | Matsko et al. | 361/115 |
| 4,263,572 | 4/1981 | Bernatt et al. | 335/26 |
| 4,419,665 | 12/1983 | Gurr et al. | 307/39 |
| 4,623,859 | 11/1986 | Erickson et al. | 335/14 |
| 4,725,800 | 2/1988 | Grunert et al. | 335/38 |
| 4,931,758 | 6/1990 | Bagalini | 335/174 |
| 5,186,308 | 2/1993 | Munro | 198/572 |

*Primary Examiner*—Stephen W. Jackson
*Assistant Examiner*—Rios Roberto
*Attorney, Agent, or Firm*—Patent & Trademark Services; Thomas Zack; Joseph H. McGlynn

[57] ABSTRACT

A shunt trip and switch breaker used to shut off electrical power to an electrical panel such as used to control the operation of electrical equipment for dispensing gasoline in a station. In order to insure that the breaker is not prematurely opened, for whatever reason, the power being supplied to operate the electrical panel is also continuously at the same time being supplied to the shunt trip. When a remote emergency button (E-button) connected to the shunt trip is actuated by depression, the shunt trip moves in unison with a connected circuit breaker to shut down power to all of the elements including those operated by the electrical panel. The switch breaker may have two movable handle elements that are operatively tied together to move in unison with similar elements on the shunt trip. The handle elements are controlled by the remotely generated input signal applied to terminal port on the trip shunt when the E-button is actuated.

4 Claims, 3 Drawing Sheets

FIG. 4
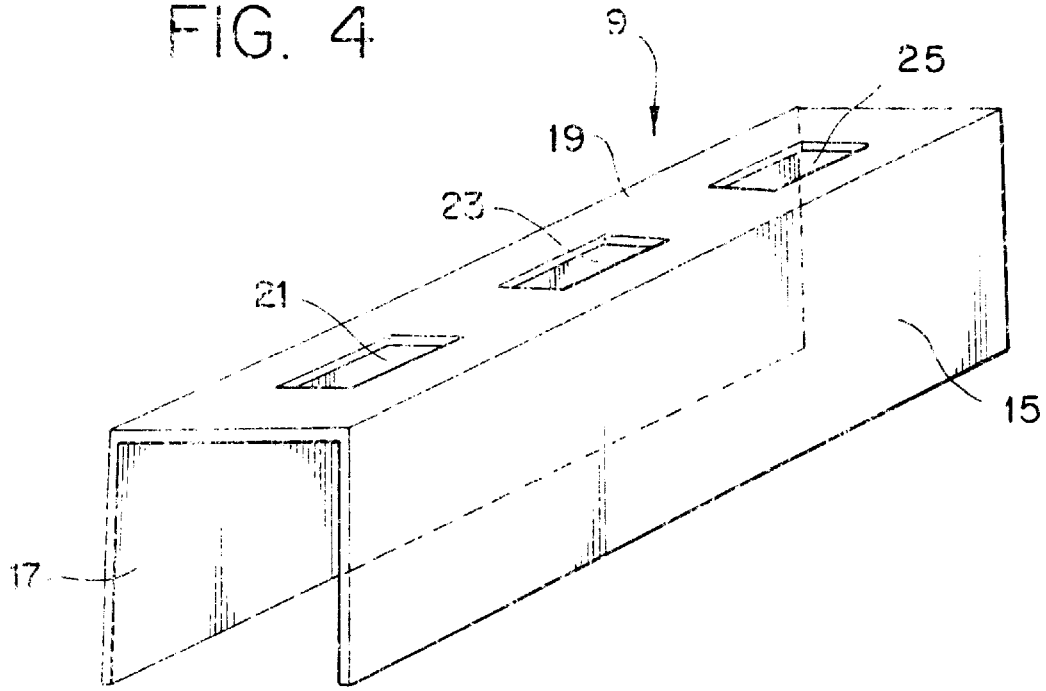
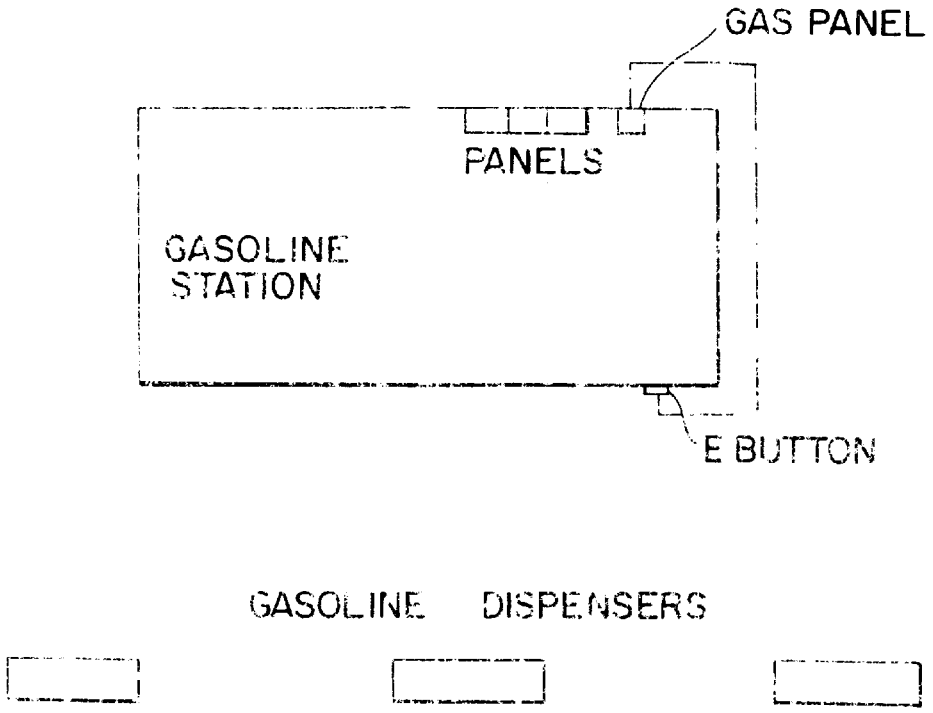
FIG. 5

NEUTRAL SWITCHED SHUNT TRIP EMERGENCY GAS PANEL

BACKGROUND OF THE INVENTION

For safety or other reasons it is sometime desirable to use a shunt trip to actuate a breaker and stop the flow of electricity. One particular application is that used in a gasoline station environment where one or more distinct separated panels are electrically interconnected. Normally the panel used to control the electrical power to gasoline dispensing pumps is isolated from the other panels used to control electrical power to the other electric elements in the station such as the light plugs, air conditioning, coolers, etc. This isolation is necessary because of the chance of an accident outside the area of the pumps. This isolated panel houses the particular electrical control elements needed to operate the typical electrically operated components found in a gasoline station such as the electrically pump motors used to control the gasoline pump and visually displayed information such as the dispensed amount of gasoline from the station's holding tanks to customers and the price. With such an arrangement, an emergency (E) stop button is usually employed. This E stop button is generally found outside or by an attendant and is used if there is a problem in actuating a shunt trip circuit. This trip circuit has its actuation controlled by a first circuit breaker in the gas panel or there may be a second remote breaker connected such that this second breaker can control the first circuit breaker that feeds the shunt trip. Normally, the E stop button (E-button) and its associated shunt and breaker circuitry has no current flowing through them and are in an inactive state until all of the associated breakers the shunt trip are activated when the E button is depressed to place it in an ON position.

One problem that has occurred with the foregoing type of set up is that sometimes someone, for whatever reason, deactivates the first breaker or a connected second breaker connected to the first breaker. When either of these breakers are deactivated, there is a system failure and the E stop button will not work as intended. Thus, the very purpose of having an E-stop button is defeated. The inability of the E-button to perform as contemplated can result in a very dangerous and life threating situation with the possible loss of considerable property damage as well.

The present invention is directed to a E stop button and its associated shunt trip and breaker that is maintained in a constant live state in a continuous manner as long as electricity is flowing to the controlled electrical components in the panel to insure that when the E-stop button is depressed activated of the shunt and breaker will occur in an actual emergency and not be defeated.

DESCRIPTION OF THE PRIOR ART

Electrical trip shunts circuits that are connected to existing circuit breakers are known. For example, in the Bernatt et al. invention (U.S. Pat. No. 4,263,5728) the shunt trip mechanism includes a ratchet facility added to a self-contained line potential stored-energy operating mechanisms of a circuit interrupting device.

The Erickson et al. invention (U.S. Pat. No. 4,623,859) discloses a remote control circuit breaker wherein the remote control assembly opens and closes the circuit breaker independently of the trip mechanism.

The Grunert et al. invention (U.S. Pat. No. 4,725,800) describes a circuit breaker structure with a faster trip unit having a hold-back bracket that causes the magnetic field lines to flow through the bracket and an armature.

The Bagalini invention (U.S. Pat. No. 4,931,758) discloses an electromagnetic shunt trip device with a pair of aligned plungers that can be tripped by an electromagnetic generated field.

SUMMARY OF THE INVENTION

This invention relates to an improved shunt trip and switch breaker that operate in unison and may utilize a connecting tie bar. Current is only supplied to the shunt trip when current is being supplied to operate the electrical equipment in the electrical panel.

It is the primary object of the present invention to provide for an improved switch breaker circuit and connected shunt trip that are maintained continuously in a ready or operative state as long as current is being applied to the panel's controlled electric components.

Another object is to provide for such a circuit wherein the emergency button connected shunt trip is physically interconnected to a circuit breaker by a tie bar to move together.

These and other objects and advantages of the present invention will become apparent to readers from a consideration of the ensuing description and the accompanying drawings.

BRIEF DESCRIPTION OF THE DRAWINGS

FIG. 4 is a perspective view of a tie bar.

FIG. 5 is a block diagram of the invention showing its use in a gasoline dispensing station.

DESCRIPTION OF THE PREFERRED EMBODIMENT

Figure 1:
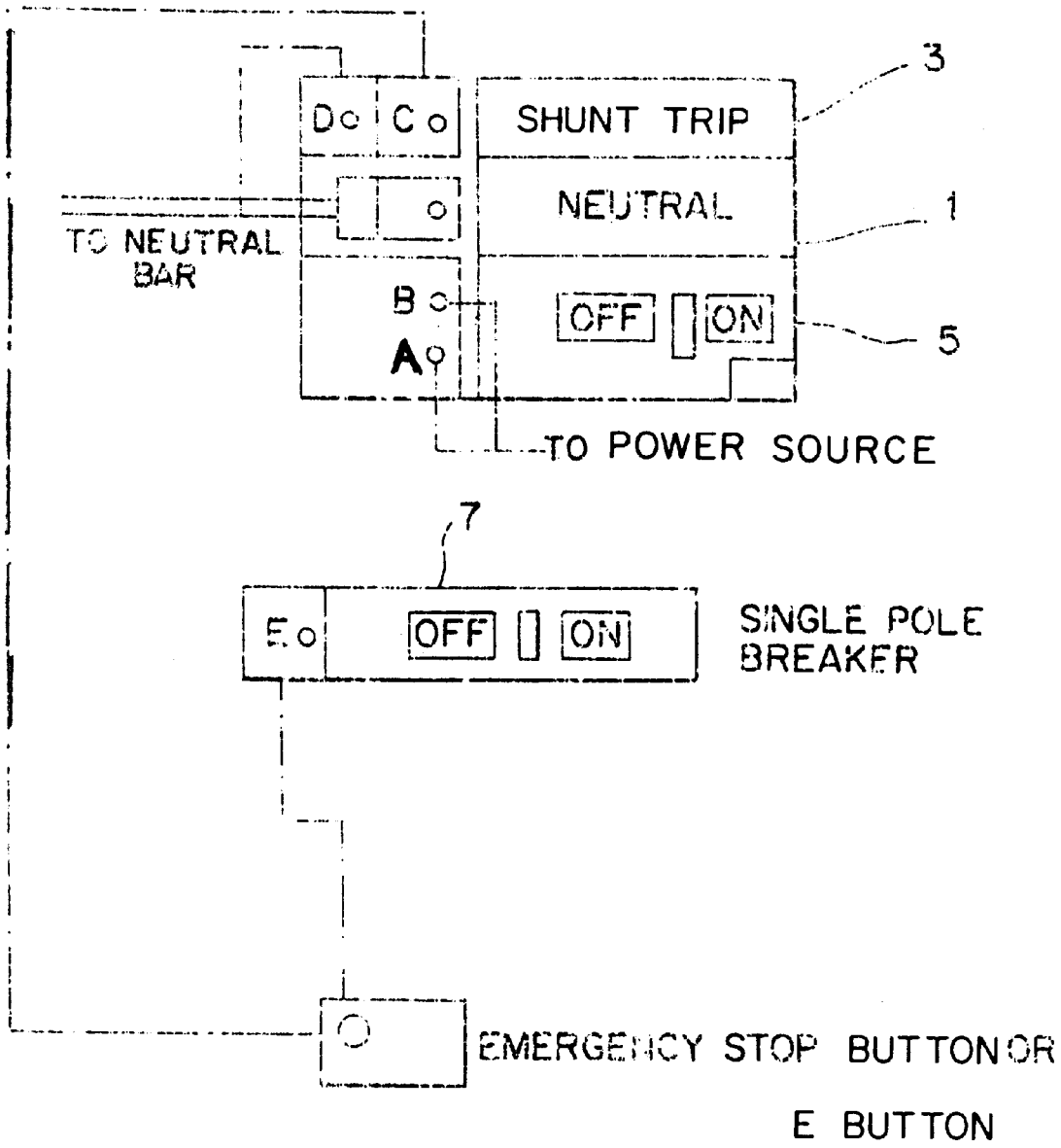
FIG. 1 PRIOR ART
FIG. 1 is a schematic view of a typical prior art embodiment wiring set up for an existing shunt trip with a switch breaker.

FIG. 1 is a schematic view of a typical prior art embodiment wiring set up for an existing shunt trip with a neutral switch breaker. The upper circuitry 1 is normally installed in a panel to control the operation of the electrical components associated with that particular panel. In the same or different electrically interconnected separate panels are the circuit breakers (switches, fuses, etc.) that are controlled by the shunt trip 3. The lugs B and A of the double pole breaker 5 are connected to the panel to be disconnected and the lug D is connected to ground (or neutral) voltage level via the neutral bar. The shunt trip lug C is connected to the remote E (emergency) stop button and is supplied activating current only when the button is depressed to an operative position. The breaker lugs or terminals A and B are fed from the system's power source and are positioned to shut the system down when in an OFF state. If the shunt's activating circuit breaker 7 in the same panel—or it could be in a remote panel—for some reason, like a mistake, is turned off then the shunt trip is not actuated by depressing the E stop button and the circuitry will not shut down as desired. If the standard breaker lower single pole breaker 7 is used in place of the bipole breaker 5, it would normally be installed in a panel and would have one of its terminals electrically connected to the terminal C lug.

Figure 2:
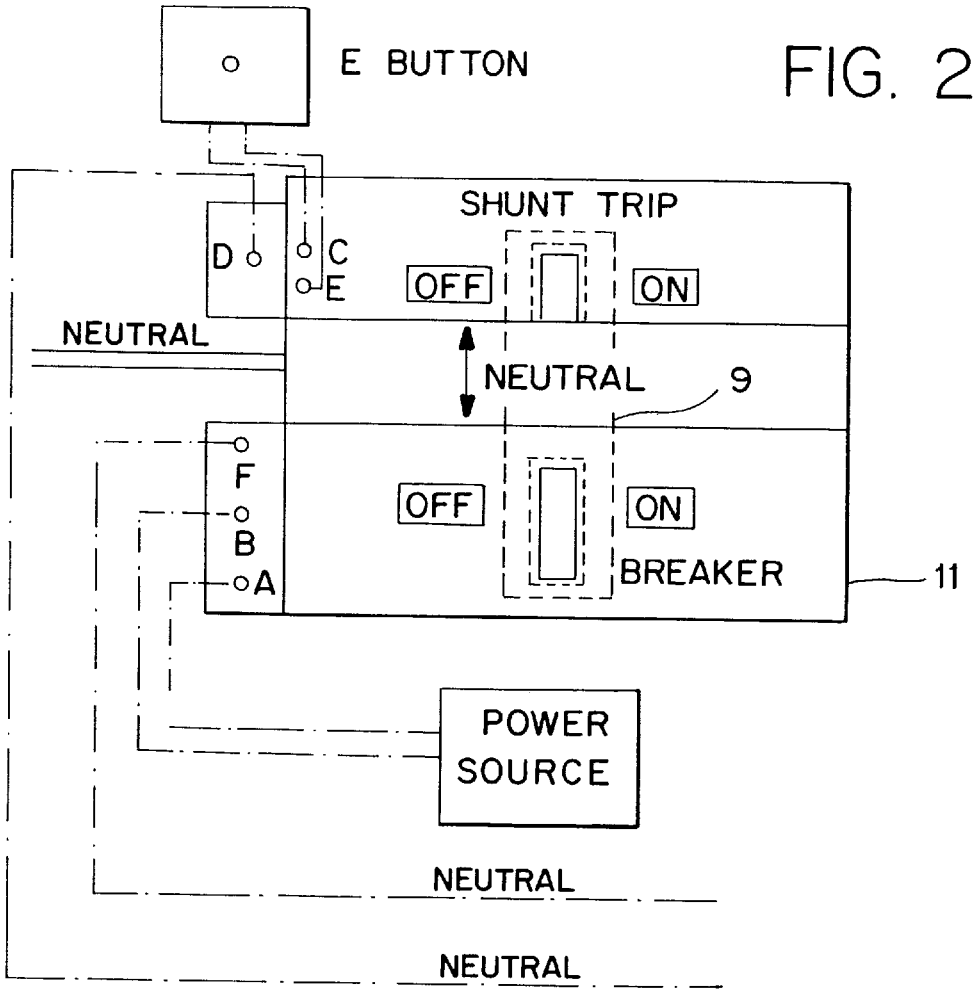
FIG. 2 is a schematic view of the wiring set for the present invention.

FIG. 2 is a schematic view of the wiring set for the present invention. As in the prior art breaker terminals A and B are fed from the power source used to power the panel and terminal D goes to the neutral bar. The breaker's terminal F also goes to neutral. The remote E-button is connected to the shunt trip's live terminal E which is different from the prior art. Also a connecting tie bar 9 (shown in dotted line format) has elements that interconnects the shunt trip with the elements on the bipolar breaker 11 having terminals A and B to move in unison with the breaker. Tie bar 9, whose typical configuration is shown in FIG. 4, is an elongated rigid member with aligned through holes. These through holes receive actuating members in the shunt trip and the breaker 11. When the tie bar is moved (see arrows in FIG. 2) the actuating members for the shunt trip and breaker move with the bar. Thus, the shunt trip and the breaker have their operations tied together such that they are both either ON or OFF together. By depressing the shunt trip connected E-button, both the breaker and the shunt trip operate in unison as a single unit with this set up. This insures that the breaker will not be accidentally actuated and unable to shut down the circuitry connected to them without shutting down all power to the panel. If the breaker is shut off, for whatever reason, the shunt trip also is shut off. This action results in the power being supplied to a connected electrical panel used to control electrically operated equipment being shut down as further described with respect to FIG. 3.

Figure 3:
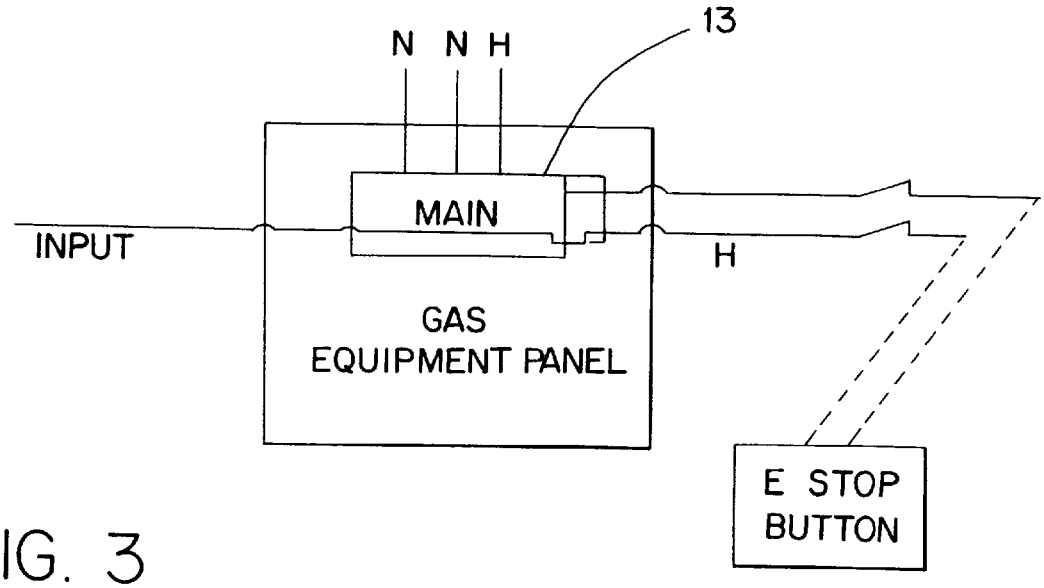
FIG. 3 is a block diagram of the present invention showing its use in a Main Breaker.

FIG. 3 is a block diagram of the invention showing its use with a gas equipment panel. This figure is essentially the same as FIG. 2 except that the main breaker 13 houses what is shown in FIG. 2. Sometimes what is shown in FIG. 2 is referred to as Plug-in-Main in a Main Lug Panel. The main electric panel equipment is being used where dangerous ambient gasoline fumes may be present like in a gasoline station.

FIG. 4 is a perspective view of a typical tie bar 9. The rigid elongated bar has two opposite side panel legs 15 and 17. These legs are essentially identical and parallel to each other. Joining the side legs is a planar top surface 19. This top surface has three aligned and spaced through holes 21, 23 and 25. Each of these through holes receives and engages actuating members in the shunt trip and the breaker 11. When the tie bar as a whole moves to the left or right in FIG. 4, the surface 19 and its holes moves along with the actuating members. This movements imparts unison of action to the engaged actuating members.

FIG. 5 is a block diagram of the present invention showing it used in a gasoline dispensing station. In this figure the gas equipment panel within the gasoline station would be connected as previously shown and described with respect to FIG. 3. Thus, the shunt trip in the gas panel controlled by the E-button is fed from a breaker and maintained in a ON or hot state as long as current is flowing to the gas equipment panel. This insures that the breaker for the shunt trip will not be actuated without shutting down all current flow to the gas panel equipment. Either the shunt trip and its breaker are in a state where the actuation of the E-button will break the circuit or the complete flow of current to all of the equipment controlled by the gas(oline) equipment panel is disconnected. This eliminates the situation where the breaker or breakers associated with the shunt trip and E-button can be prematurely actuated, for whatever reason, to open the circuit and prevent the E-button from performing as intended in an emergency situation. The three other panels house controlling elements for other equipment typically found in a gasoline station not involved with the dispensing of gasoline such as controls for the air conditioning of the station, beverage cooler controls, lighting, etc.

Another environment where the principles of this invention could be used is in the restaurant environment. Some restaurant hoods over cooking grills have shunt trips with a breaker. The shunt trip and breaker are used to shut down power to the cooking grill. In case of a fire the shunts are used to shut down the grill and the exhaust fans to prevent air from fueling the fire. However, in many of these set ups, if the breaker associated with the shunt trip and E-button is accidentally turned off the electrical power to the shunt trip is also turned off. Depressing the E-button, in such a situation, results in no power being sent to the shunt trip and as a result the normally covering hood for the cooking grill cannot be electrically shut down over the fire. It should be clear that gasoline applications must be neutral switched, however, in restaurant equipment uses as well as other applications such neutral switched may not be required.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A circuit for maintaining a shunt trip operable in an emergency comprising in combination:

an electrical panel having a source of supplied electrical power, said panel being used to control the supplying of electrical power to electrically operated equipment connected to the panel;

said electrical panel being operatively connected to a shunt trip having an associated circuit breaker that can be used to disconnect a source of supplied electrical power to the panel;

said source of supplied electrical power being supplied to the shunt trip and the electrical panel and being connected to operative in unison with the shunt trip to be either in an on or off state at the same time; and a remote emergency button operatively associated with said shunt trip for actuating the shunt trip and breaker to disconnect the supply of electrical power to the electrical panel.

2. The circuit for maintaining a shunt trip operable in an emergency as claimed in claim 1, wherein:

said electrically operated equipment connected to the panel includes gasoline dispensing equipment remote from said panel and said emergency button.

3. The circuit for maintaining a shunt trip operable in an emergency as claimed in claim 2, wherein:

said shunt trip has a first electrical terminal, a second electrical terminal and a third electrical terminal connected to electrical ground;

said first and second electrical terminals being electrically connected to receive remotely inputted signals applied to the shunt trip from said emergency button;

said breaker being connected to said shunt trip to operate in unison with the shunt trip by a connecting tie bar between the breaker and the shunt trip, and said input signal to said shunt trip only being operative when power is being supplied to said electrical panel from said power source for the electrical panel.

4. The circuit for maintaining a shunt trip operable in an emergency as claimed in claim 3, wherein:

said breaker receives electrical signals from the electrical power source used to electrically power the electrically control equipment on the panel.

* * * * *